US007983601B2

(12) United States Patent
Spence et al.

(10) Patent No.: US 7,983,601 B2
(45) Date of Patent: Jul. 19, 2011

(54) TELESCOPIC AUGER DISPENSE DROP TUBE

(75) Inventors: James J. Spence, Honeoye Falls, NY (US); James E. Baxter, III, Canandaigua, NY (US)

(73) Assignee: Xerox Corporation, Norwalk, CT (US)

( * ) Notice: Subject to any disclaimer, the term of this patent is extended or adjusted under 35 U.S.C. 154(b) by 386 days.

(21) Appl. No.: 12/250,925

(22) Filed: Oct. 14, 2008

(65) Prior Publication Data

US 2010/0092216 A1 Apr. 15, 2010

(51) Int. Cl.
*G03G 15/08* (2006.01)

(52) U.S. Cl. ..... 399/258

(58) Field of Classification Search ..... 399/258
See application file for complete search history.

(56) References Cited

U.S. PATENT DOCUMENTS

| | | | | |
|---|---|---|---|---|
| 5,079,593 | A * | 1/1992 | Satoh et al. | 399/111 |
| 5,099,986 | A * | 3/1992 | Kuzub | 198/666 |
| 6,197,114 | B1 * | 3/2001 | Rodenberger | 118/623 |
| 2005/0013633 | A1 * | 1/2005 | Harumoto | 399/258 |

FOREIGN PATENT DOCUMENTS

| | | | |
|---|---|---|---|
| JP | 04191869 | A * | 7/1992 |
| JP | 09026680 | A * | 1/1997 |
| JP | 2002209428 | A * | 7/2002 |
| JP | 2003164219 | A * | 6/2003 |

* cited by examiner

*Primary Examiner* — David M Gray
*Assistant Examiner* — G. M. Hyder
(74) *Attorney, Agent, or Firm* — Ellis B. Ramirez; Prass LLP

(57) ABSTRACT

A toner transport apparatus for a printing system in which toner is moved from a toner container to a developer housing. The toner transport apparatus can accommodate different lengths and orientations between the toner container and the developer housing. The apparatus discloses a variable length component that expands or contracts to extend the toner transport apparatus to a desired length. The toner transport apparatus can assume unique angles per station with a gear mechanism. A flexible auger can be associated with the toner transport apparatus to move material in non-vertical positions. The toner transport apparatus with the variable length component and flexible auger would provide the ability to reuse components at a variety of positions and angles.

18 Claims, 5 Drawing Sheets

TELESCOPIC AUGER DISPENSE DROP TUBE

BACKGROUND

The disclosure is directed to a dispensing apparatus having adjustable component, and more particularly, to apparatus for transporting toner material to a development housing.

Apparatuses that form images on a sheet, such as electrophotographic reproduction machine and printers are equipped with mechanisms to rotate a continuous belt at various locations inside the apparatus. The electro-photographic process, and particularly the xerographic process, is well known. This process involves the formation of an electrostatic latent image on a photoreceptor, followed by development of the image with a developer, and subsequent transfer of the image to a suitable substrate. Numerous different types of xerographic imaging processes are known wherein, for example, insulative developer materials or conductive developer particles are selected depending on the development systems used. The materials, compositions and processing for toners, which are particulate materials with colorant and fixing resin and charge control agents in dry form or in a liquid vehicle for development onto a photoreceptor, and for developers, which are materials packages containing toner particles with dry carrier or a liquid vehicle.

A development system consumes toner material in a development process and must be periodically replaced within the development system to sustain continuous operation of the electro-photographic reproduction machine. Various techniques and strategies have been used in the past to replenish such toner material. These techniques rely on the ability to manufacture customized parts, manufacture transport components to unique length, and manufacture of various mechanisms to augment the flow of the toner material from a supplier housing to the development system.

SUMMARY

A toner transport apparatus for a printing system in which toner is moved from a toner container to a developer housing. The toner transport apparatus can accommodate different lengths and orientations between the toner container and the developer housing. The apparatus discloses a telescopic component that expands or contracts to extend the toner transport apparatus to a desired length. The toner transport apparatus can assume unique angles per station with a gear mechanism. A flexible auger can be associated with the toner transport apparatus to move material in non-vertical positions. The toner transport apparatus with the telescopic component and flexible auger would provide the ability to reuse components at a variety of positions and angles.

DETAILED DESCRIPTION

Aspects of the disclosed embodiments relate to dispensing of toner material through a telescopic drop tube with a flexible auger that expands and contracts to the sizes and orientation needed.

The disclosed embodiments include a supplier and receptacle housing for receiving a material. A variable length component couples the respective housings so as to transport and deliver the material. A motor driven flexible auger positioned in the variable length component is used to transport the material when the variable length component is not vertically oriented.

The disclosed embodiments further include a transfer component, telescopic drop tube with rotatable member, and a gear assembly to dispense a material from a supplier to receptacle housing. The telescopic drop tube can expand and contract to a desired length so as to couple supply housing to receptacle housing. The rotatable member is a motor driven flexible auger that transports the material when the telescopic drop tube is not vertically oriented. The rotation of the flexible auger is through the gear assembly. The disclosed embodiment further includes an auger disposed in the transfer component for transporting the material when the component is not in a vertical position.

The disclosed embodiments further include a toner transport apparatus for a printing system comprising a toner container, a developer housing, a dispenser, a variable length component, and gear train assembly. The variable length component can be extended away from the toner container to meet design constraints. The dispenser through the gear train assembly provides different orientations resulting in developer housing placement flexibility.

The term "variable length component", in the disclosed embodiments, refers to a telescopic component that is extensible or compressible by the sliding of overlapping sections. A "variable length component" may also refer to an accordion tube, malleable tube, or the like that is extensible or compressible to a range of lengths.

Figure 1:
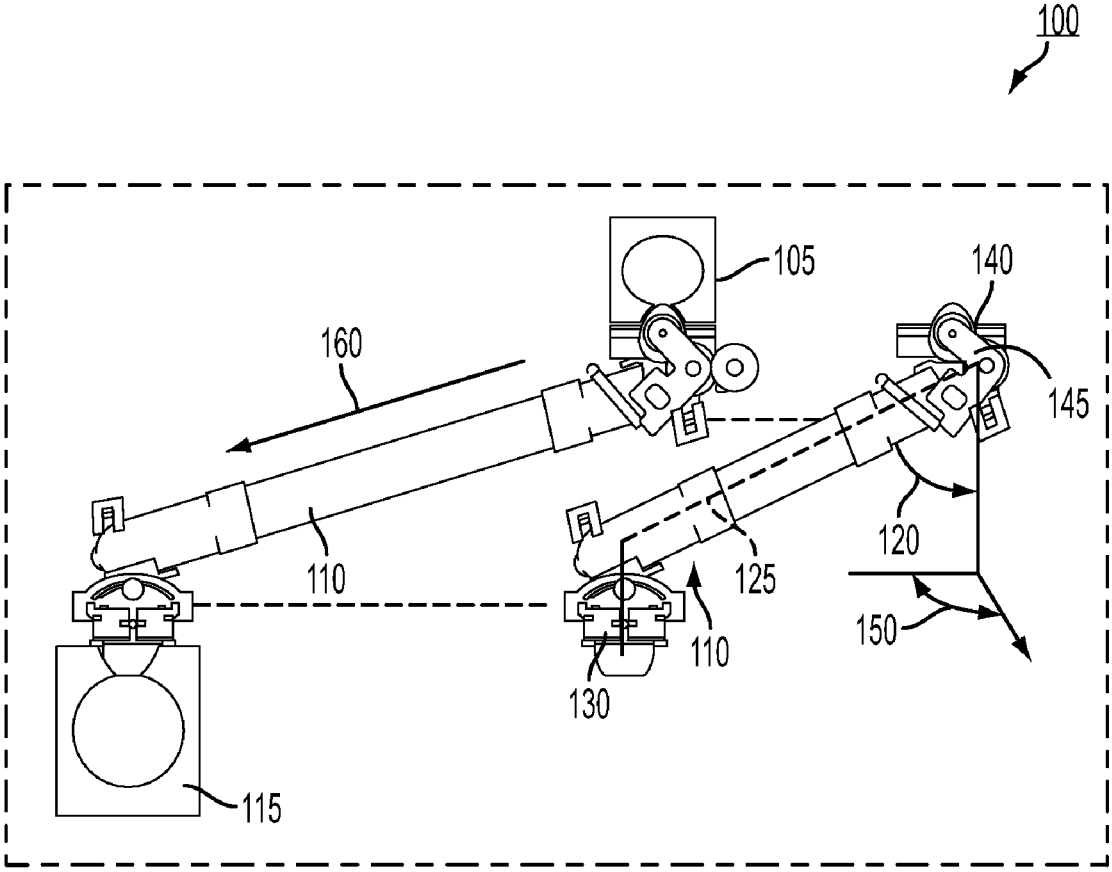
FIG. 1 is a perspective view of a variable length component in a dispenser unit in accordance to a possible embodiment.

FIG. 1 is a perspective view of a variable length component in a dispenser unit 100 in accordance to possible embodiment. In particular, dispenser unit 100 comprises a variable length component 110, a gear assembly such as pivot mechanism 145, an entry port 140 for receiving developer material or toner form a container, and an exit port 130 for delivering the dispensed develop material. The variable length component 110 comprises substantially cylindrical members that move relative to each other. A pivot mechanism 145 such as a gear train and bevel gear set provide the variable length component 110 with rotation 150 defined relative to entry port 140. The length of the variable length component 110 may be adjusted to compensate for differences in dimensions and positioning of the housings relative to each other. The variable length component defines a predetermined length 125 and a predetermined angle 120 relative to entry port 140 and exit port 130. The predetermined angle 120 and predetermined length 125 affect the dispensing key elements outlined above. For example, when variable length component 110 is in a non-vertical position, predetermined angle 120 is greater than zero degrees, a rotatable member is needed to transport the toner and to prevent built up on the inside of the variable length component 110. Predetermined length 125 illustrates a scenario where the variable length component is contracted inward or when the variable length component is not extended to its maximum length. In operation, the length of variable length component 110 can be extended 160 to achieve a desired length. Likewise, the variable length component 110 could be rotated 150, oriented or pivoted to a desired angle 120 with the toner container or supplier housing 105 and with the receptacle or developer housing 115 tethered to each end.

In a printing apparatus, such as a printer or copier, and a plurality of developer units. The overall function of a developer unit is to apply marking material, such as toner, onto suitably charged areas forming a latent image on an image receptor such as photoreceptor generally found in a printing system (not shown), in a manner generally known in the art. In various types of printers, there may be multiple such developer units, such as one for each primary color or other purpose. However, those skilled in the art would appreciate that the marking material may be in any color, such as cyan, red, magenta and yellow. If more than one color is processed in the exemplary printing system, a developer for each color may be provided in a universal developer housing.

The main elements of a developer unit are a toner container or supplier housing 105, which functions generally to hold a supply of developer material, a dispenser unit 100, which can variously mix and transports the marking material, and receptacle or developer housing 115, which in this embodiment form to apply developer material to a media to form a latent image. Other types of features for development of latent images, such as donor rolls, paddles, scavengeless-evelopment electrodes, commutators, and the like, are known in the art and could be used in conjunction with the to be described tone transport apparatus. Refilling each developer housing 115 from the associated supplier housing or toner container 105 can include a distribution mechanism, dispenser unit, flexible tube, or toner transport tube or pipe there between having, for example, an auger or spiral member including a spring rotatable within the tube for transporting the toner from each supplier housing to the respective developer housing. Each supplier housing is thus in fluid communication with the respective developer housing. The developer material or toner may then be dispensed into the developer housing 115 during an initial tone up and then during all printing to maintain the proper toner concentration (TC). The quantity, level, or toner concentration may be detected by a TC sensor (not shown). The concentration amount of the toner supplied to developer housing 115 may be controlled to adjust the concentration. Such amount may be determined by the toner concentration detected by the TC sensor to reach a predetermined concentration level based on time interval, specific model type of the printing machine, specific color, and the like, and may be controlled by small increments manually or automatically using a toner dispense motor (not shown).

The effective length, size, and orientation of dispenser unit 100 are key elements. These elements must be selected with regard to concentration and intended running speed, in pages per minute, of the printing system. Typically, but not necessarily, operating a developer unit in accordance with a desired running speed involves rotating one or more of the various rotating members within the developer unit (augers, magnetic rolls, paddles, etc.) at predetermined feed rates or speeds. However, it should be noted that the use of a rotating member to transport the toner is only needed in non-vertical scenarios. Additionally, rotating a rotatable member such as auger at a particular rotational velocity will affect the amount of marking material in the respective housings. Therefore, the length, orientation, and other attributes will have an effect on the overall performance of the developer unit 100 when it is run at a given speed.

Figure 2:
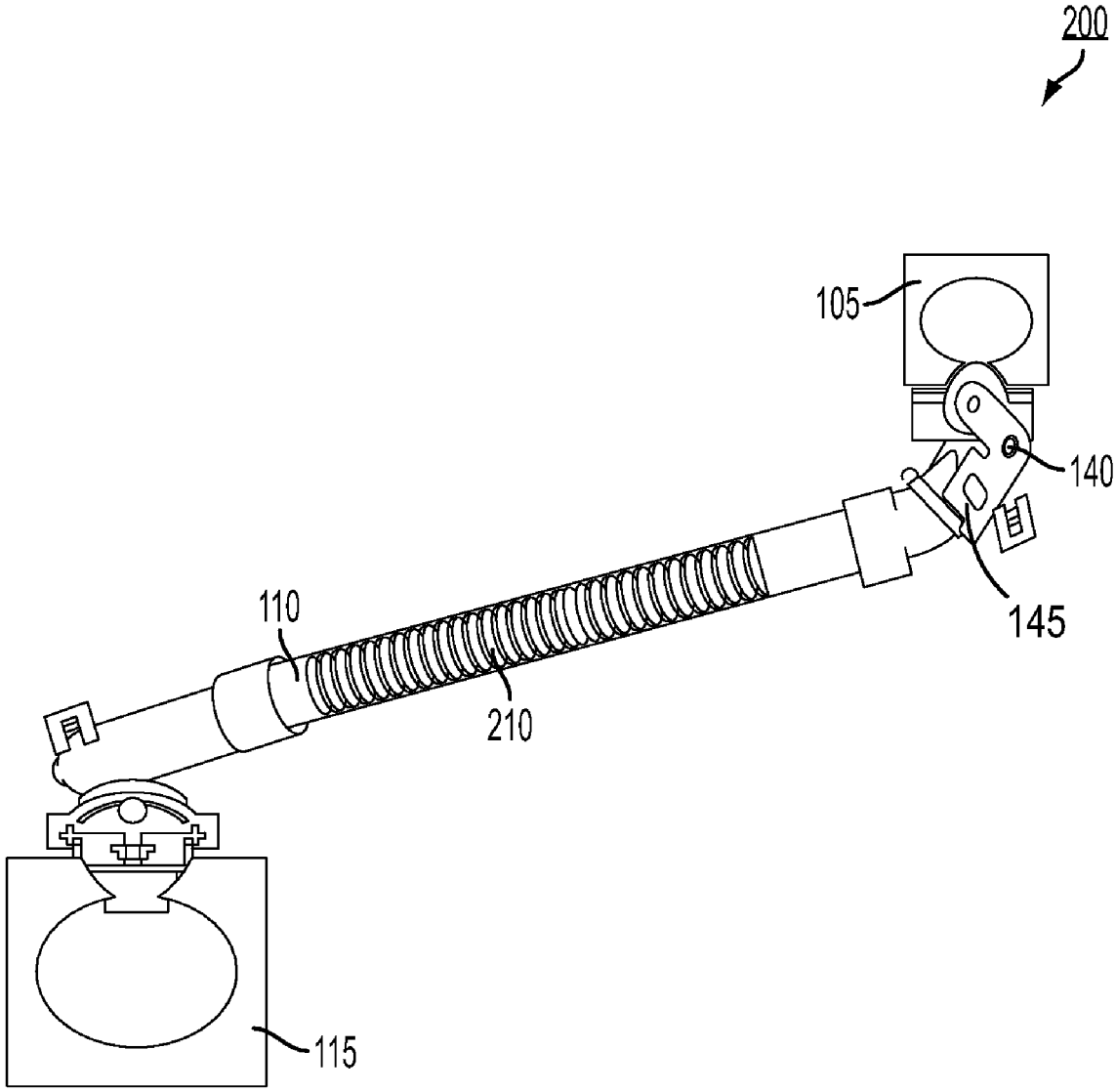
FIG. 2 is a perspective view of a variable length component using an accordion tube in accordance to a possible embodiment.

FIG. 2 is a perspective view of a dispenser 200 having a variable length component using an accordion tube in accordance to a possible embodiment. In particular, dispenser unit 200 comprises a variable length component 110, a gear assembly 145, an entry port 140 for receiving a material form a container, and an exit port for delivering the dispensed material. The variable length component 110 and the receptacle 115 may be secured by an appropriate engagement method, securing device, or bond. Communication between the entry port and the exit port is provided by an accordion tube 210 that extends into receptacle 115.

Figure 3:
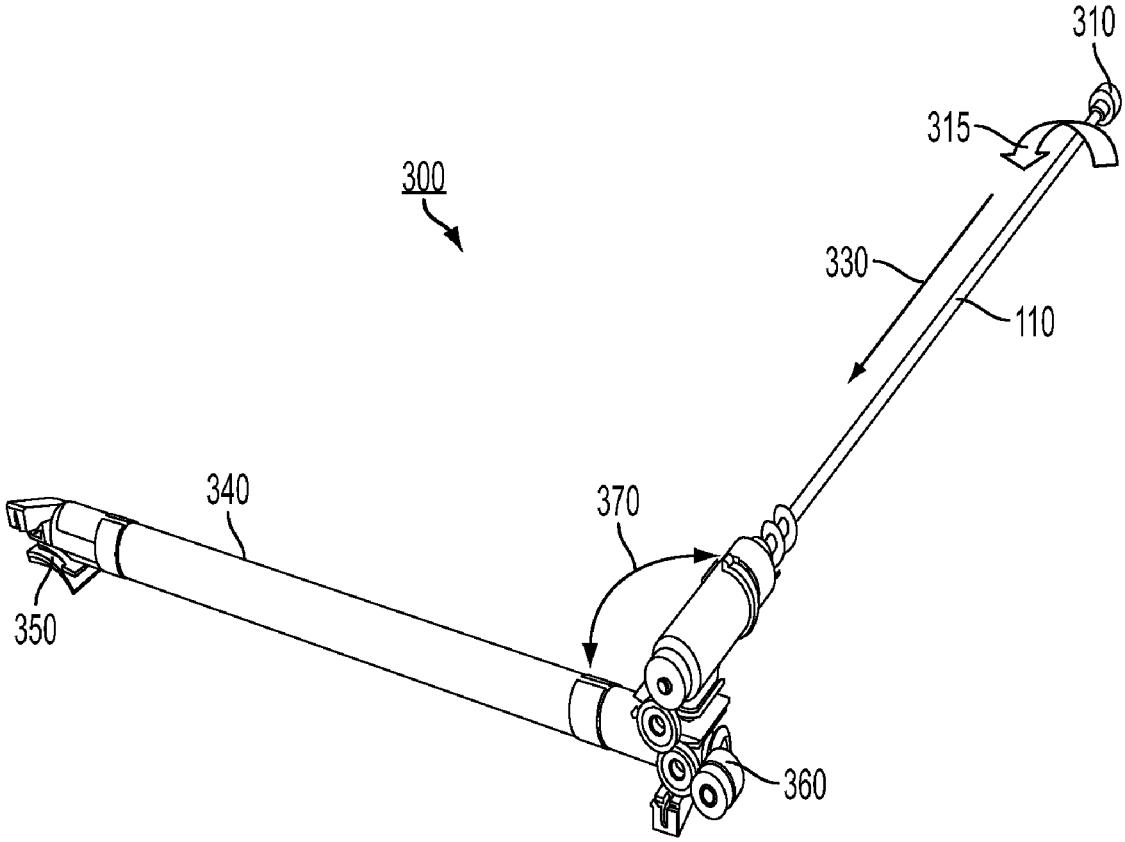
FIG. 3 is a perspective view of transfer component, gear train assembly which is illustrated in FIG. 4, and telescopic drop tube in accordance to a possible embodiment.
Figure 4:
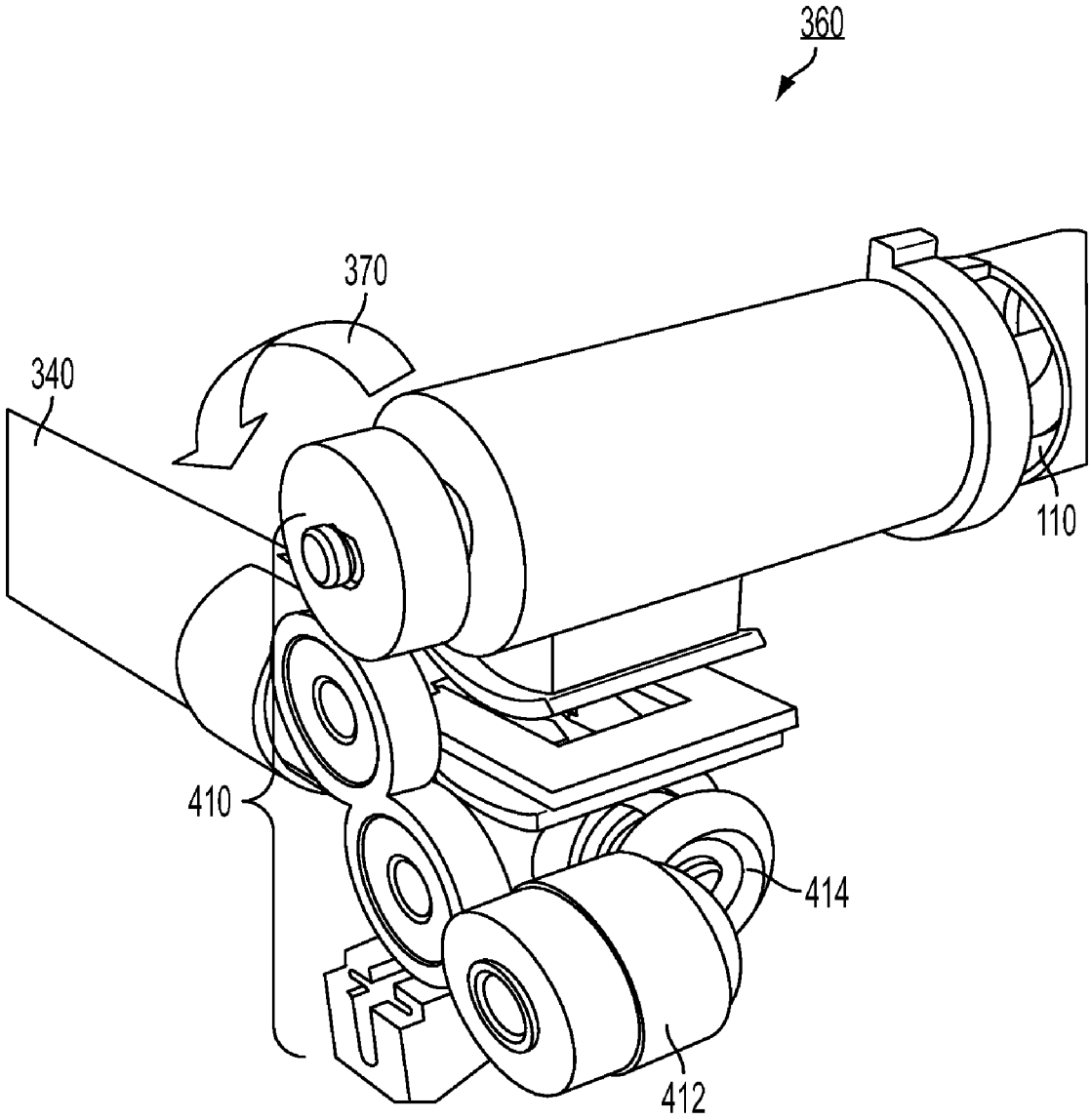
FIG. 4 is an illustration of gear train assembly in accordance to a possible embodiment.

FIG. 3 is a perspective view of a dispensing apparatus 300 having transfer component, gear assembly illustrated in FIG. 4, and telescopic drop tube in accordance to a possible embodiment. In particular, the dispensing apparatus comprises an entry port 310, an exit port 350, a dispenser or telescopic drop tube 340, a variable length component 110, and a gear assembly 360. Gear train assembly 360 connects the telescopic drop tube 340 and variable length component 110. A material is introduced into variable length component 110 in a direction 330 away from entry port 310 or in a direction 330 towards gear assembly 360 and exit port 350. A rotating member having a plurality of apertures therein or an auger made from a helical spring can be mounted in either telescopic drop tube 330 or variable length component 110 to transport and deliver the material to its destination. A flexible auger is used when telescopic capabilities and transportation of material is needed for a particular job. A motor rotates 315 the helical spring or member to advance the toner particles through the tube so that toner particles are dispensed from the apertures therein. Actuation of the motor can be controlled by a CPU (not shown) or a suitably programmed computer (not shown). A gear train assembly 360 is a gear train and bevel gear set that enable transmission of power into a rotating member and also rotation 370 of the dispenser about gear train assembly 360. Telescopic Drop tube 340 and variable length component 110 could both have telescopic capabilities and both could be equipped with a rotatable member such as auger for transporting the material. The tube would utilize a telescopic tube that can be extended or contracted to variety of fixed ranges to achieve a desired length. The wider of the tubes such as telescopic drop tube 340 would be at the bottom to prevent the build up of material at gear train assembly 360 where the two tubes meet. The tube would contain a flexible auger that expands and contracts corresponding with the length of the tube. The auger is required for non-vertical drop tubes, so that toner material does not build up on the inside of the tubes. Rotating coupling mechanism such as gear train assembly 360 would have to be used at the connection between telescopic drop tube 340 and the transfer tube such as variable length component 110, so that the connection of the drop tube would work regardless of the angles.

FIG. 4 is an illustration of gear train assembly 360 in accordance to a possible embodiment. Gear train assembly 360 shows an example of a gear construction to which the rotative driving of the rotatable member such as a flexible auger is inputted, reference numeral 410 and 412 designates a first set of gears facing a first axis. Reference numeral 414 denotes a second gear facing a second axis. The first set of gears 410 and the second gear 414 work together to generate power and speed to an attached device such as a rotatable member. The gears in the first axis (410, 412) are parallel to each other, the gears on the end portions of telescopic drop tube 340 and telescopic component 110 transmit drive from the rotatable member within the tubes. The use of a helical gear or a bevel gear or the like as one of the gears as shown makes it possible to directly bring the gears into meshing engagement. The first gear 410 interposes a gear between the top gear and the bottom gear to thereby construct a gear train, and provide a bevel gear in the gear train to thereby change the inclination of the rotary central shaft. In operation a rotation from a driving member such as a motor at one end of telescopic component 110 causes the top gear of the first gear to rotate in the direction shown by arrow 370. The rotation of the top gear is translated to the other gears so that second gear 414 rotates and the generated motion is used to rotate the rotatable member.

Figure 5:
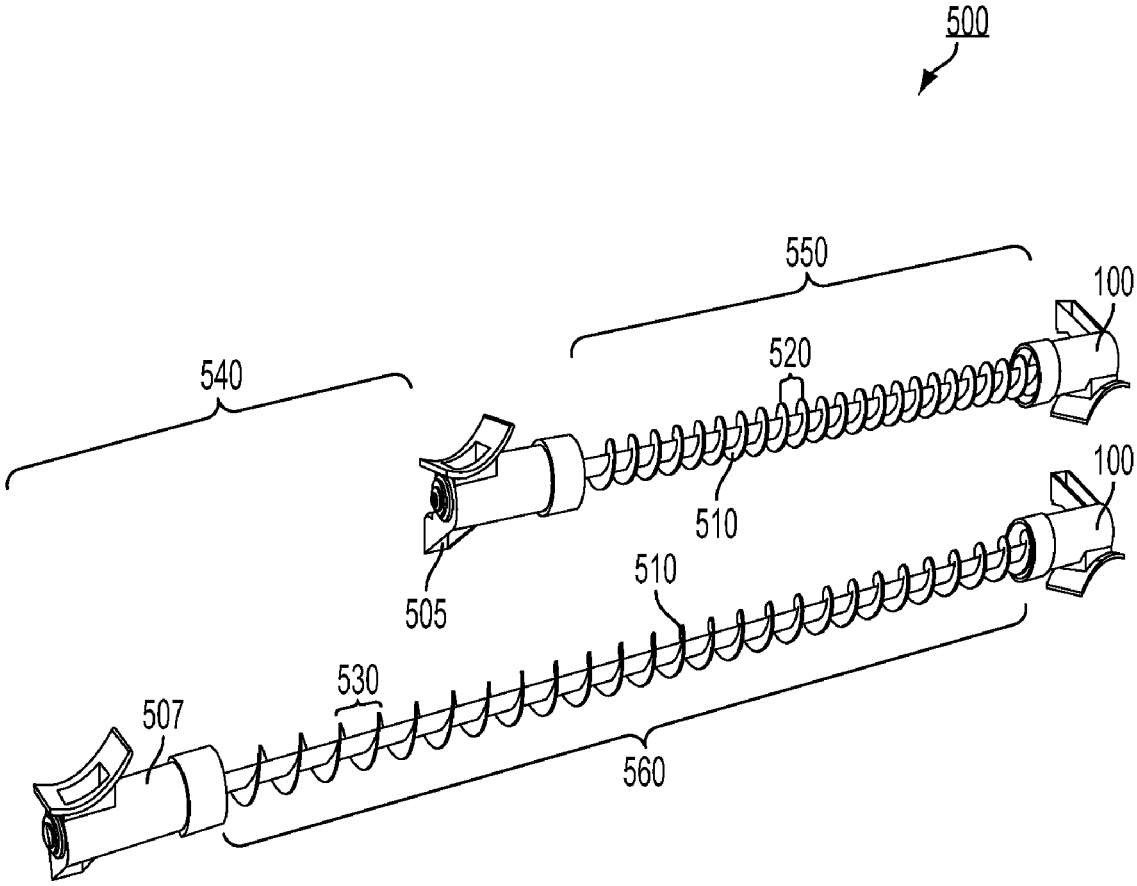
FIG. 5 is a perspective view of a flexible auger in accordance with a possible embodiment.

FIG. 5 is a perspective view of a flexible auger 500 in accordance with a possible embodiment. Flexible auger 500 has a plurality of blades 510 attached at each end of the telescoping core or variable length component. The flexible auger is disposed within the dispenser unit as shown in FIG. 1. The rotational core size of the flexible auger is varied to maintain a uniform constant cross sectional filling factor within the dispenser unit. Preferably the core is round and the root diameter is varied in a fashion so as to compensate for the volume of developer material that has been picked up at an entry port and used for development at point beyond the exit port. As a general rule the volume discharged by the flexible auger is a function of the diameter (D) of the rotational core, flexible auger pitch (P), and flexible auger rotational period T). The pitch of the flexible auger is a variable component that changes with the length. Flexible auger 500 expands and contrasts in proportion to length adjustment of the tubing where the flexible auger is disposed within. An expansion and contrasting of the flexible auger causes the pitch to varied. The motor rate or the rotational period needs to be adjusted to maintain a constant flow to compensate for pitch variability. In a first position 505 the flexible auger has a first length 550 and the blades of the flexible auger are a first pitch 520. In a second position 507 the flexible auger is expanded by an incremental length 540. The expanded length 560 causes the blades of the flexible auger to a second pitch.

Although the illustrated embodiments disclose a monochrome xerographic printer where a toner image is transferred from a photoreceptor directly to a print sheet, a "charge receptor" can also be an intermediate member or belt that accumulates a set of primary-color toner images from a set of photoreceptors in a color printing apparatus. Thus, transfer stations such as generally described and indicated as in the Figures can be used to transfer toner images from such an intermediate member to a print sheet. As used herein, the term "printing apparatus" may refer to a developer unit installable in a printer; to a customer-replaceable unit installable in a printer, including or not including a photoreceptor 10 or a developer supply; to a printer itself; or to a printing module in a larger, multi-engine printer.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A dispenser for dispensing development material in a printing system, comprising:

a supplier housing to retain a dispensable development material to form a latent image on a media;

a variable length component positioned between the supplier housing and a receptacle housing to transport and deliver the dispensed material to the receptacle housing, wherein the variable length component is extensible or compressible;

a pivot mechanism attached to an end of the variable length component and to the supplier housing, wherein the pivot mechanism allows the variable length connector to pivot about a first axis and to rotate about a second axis; and a receptacle housing to receive a dispensed development material to form a latent image on a media;

wherein the pivot mechanism and the variable length component allows the receptacle to be placed at a variety of positions and angles from the supplier housing.

2. The dispenser of claim 1, further comprising:

a rotatable member disposed within the variable length component to transport the dispensed development material to the receptacle housing.

3. The dispenser of claim 2, wherein the rotatable member is a flexible auger.

4. The dispenser of claim 3, wherein the flexible auger expands and contracts in proportion to variable length component adjustment.

5. The dispenser of claim 3, wherein the variable length component can be positioned at a predetermined angle relative to the supplier housing and the receptacle housing.

6. The dispenser of claim 5, further comprising:

a drive mechanism operatively connected to the rotatable member so as to rotate the flexible auger.

7. The dispenser of claim 6, wherein the drive mechanism is a variable speed motor that rotates the flexible auger at a varying rate.

8. A dispenser apparatus to dispense development material from a supplier housing to a receptacle housing in a printing apparatus, comprising:

a transfer component to transfer the development material from the supplier housing;

a telescopic drop tube having an exit port for passage of the development material out of the transfer component into the receptacle housing, wherein telescopic drop tube length is adjustable;

a pivot mechanism attached to an end of the telescopic drop tube and to the supplier housing, wherein the pivot mechanism allows the telescopic drop tube to pivot about a first axis and to rotate about a second axis; and a rotatable member disposed within the telescopic drop tube to transport the development material to the receptacle housing.

9. The dispenser apparatus of claim 8, wherein the rotatable member is a flexible auger.

10. The dispenser apparatus of claim 9, wherein the flexible auger expands and contracts in proportion to telescopic drop tube length adjustment.

11. The dispenser apparatus of claim 8, wherein the telescopic drop tube can be positioned at a predetermined angle relative to the transfer component.

12. The dispenser apparatus of claim 11, further comprising:

a drive mechanism operatively connected to the rotatable member so as to rotate the flexible auger.

13. The dispenser apparatus of claim 12, wherein the drive mechanism rotates the flexible auger through the gear train assembly.

14. The dispenser apparatus of claim 13, further comprising:

an auger disposed within the transfer component to transport the material to the telescopic drop tube.

15. A toner transport apparatus for a printing apparatus, the toner transport apparatus comprising:

a toner container for holding and dispensing a supply of toner material;

a developer housing located at a given distance from the toner container;

an accordion tube dispenser coupled to the developer housing, the accordion tube dispenser defining a predetermined length and a predetermined exit surface angle for toner material passing through the accordion tube dispenser at an exit port;

a variable length component in the accordion tube dispenser to transport toner material away from the toner container, wherein the variable length component is extensible or compressible; and a pivot mechanism attached to an end of the accordion tube dispenser, wherein the pivot mechanism allows the accordion tube dispenser to pivot about a first axis and to rotate about a second axis;

wherein the pivot mechanism and the variable length component allows the toner container to be placed at a variety of positions and angles from the developer housing.

16. The toner transport apparatus of claim 15, wherein the variable length component is a flexible auger that can transport the toner away from the toner container.

17. The toner transport apparatus of claim 16, wherein the flexible auger expands and contracts in proportion to variable length component adjustment.

18. The toner transport apparatus of claim 17, wherein rotation of the auger is through the pivot mechanism.

* * * * *